US005495144A

United States Patent [19]

Nishida

[11] Patent Number: 5,495,144

[45] Date of Patent: Feb. 27, 1996

[54] HELICAL SLOW-WAVE CIRCUIT ASSEMBLY WITH REDUCED RF LOSSES

[75] Inventor: Kazuhisa Nishida, Tokyo, Japan

[73] Assignee: NEC Corporation, Japan

[21] Appl. No.: 186,431

[22] Filed: Jan. 25, 1994

[30] Foreign Application Priority Data

Feb. 3, 1993 [JP] Japan ..... 5-016012

[51] Int. Cl.[6] ..... H01J 23/24

[52] U.S. Cl. ..... 315/3.5; 315/39.3

[58] Field of Search ..... 315/3.5, 3.6, 39.3

[56] References Cited

U.S. PATENT DOCUMENTS

| | | | |
|---|---|---|---|
| 3,466,494 | 9/1969 | Eichin et al. | 315/3.5 |
| 4,683,400 | 7/1987 | Seal | 315/3.5 |
| 5,038,076 | 8/1991 | Smith et al. | 315/3.5 |
| 5,071,055 | 12/1991 | Grauleau et al. | 315/3.5 X |
| 5,274,304 | 12/1993 | Nishida | 315/3.5 |

FOREIGN PATENT DOCUMENTS

| | | | |
|---|---|---|---|
| 0507195 | 10/1992 | European Pat. Off. . | |
| 534762 | 3/1993 | European Pat. Off. | 315/39.3 |
| 2629634 | 10/1989 | France . | |
| 3-71535 | 3/1991 | Japan . | |

OTHER PUBLICATIONS

Patent Abstracts of Japan vol. 015 No. 236 (E–1078), 18 Jun. 1991.

*Primary Examiner*—Benny T. Lee

*Attorney, Agent, or Firm*—Laff, Whitesel, Conte & Saret, Ltd.

[57] ABSTRACT

A helical slow-wave circuit assembly includes a helix, P-BN pillars, a metal cylinder, artificial diamond films, and intermediate films. The helix constitutes a slow-wave circuit of the electromagnetic wave with respect to an electron flow and generates an electromagnetic wave that travels as a current flows. The P-BN pillars are disposed equidistantly around the helix in a direction along which the electromagnetic wave travels, and contains at least nitrogen. The metal cylinder supports the helix therein through the P-BN pillars. The artificial diamond films are formed on outer circumferential surfaces of the P-BN pillars. The intermediate layers are formed between the P-BN pillars and the artificial diamond films and prevents diffusion of nitrogen from the P-BN pillars to the diamond films.

6 Claims, 3 Drawing Sheets

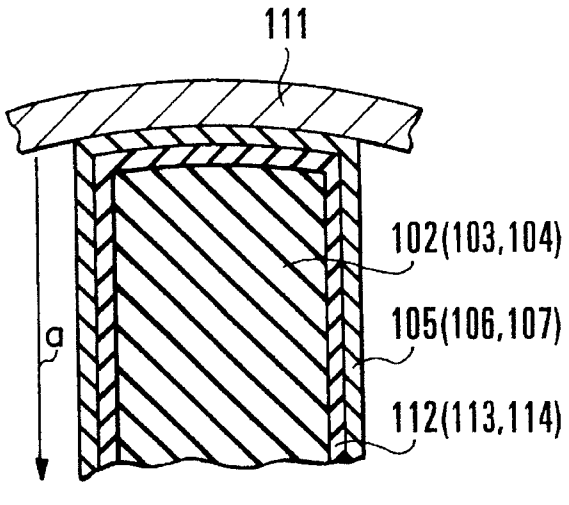
FIG.2
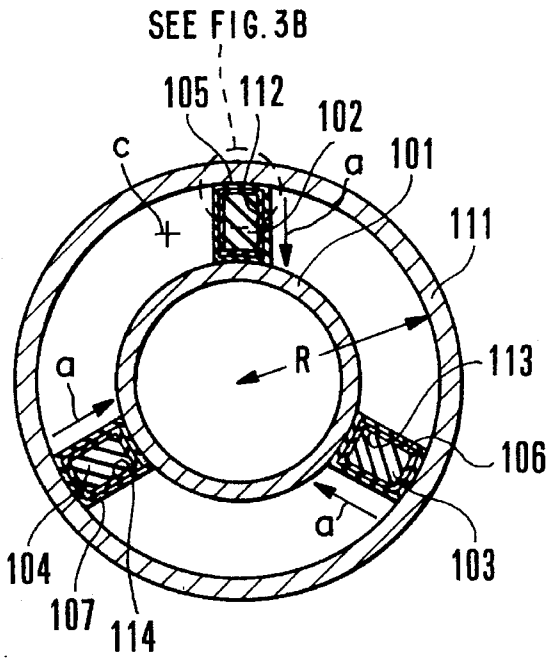
FIG.3A
FIG.3B

HELICAL SLOW-WAVE CIRCUIT ASSEMBLY WITH REDUCED RF LOSSES

BACKGROUND OF THE INVENTION

The present invention relates to a helical slow-wave circuit assembly and, more particularly, to a helical slow-wave circuit assembly utilized in, e.g., a traveling-wave tube and a backward-wave tube.

Electron beams pass through a helical slow-wave circuit in a traveling-wave tube or a backward-wave tube as they partly come close to the circuit. Thus, the helical slow-wave circuit is heated by heat generated when the electron beams partly collide against the helical slow-wave circuit, or by heat generated by resistance loss of an RF power transmitted through the helical slow-wave circuit. Due to this heating function, a helical slow-wave circuit having a comparatively small heat capacity reaches a rather high temperature. This leads to an increase in RF power loss and an increase in gas emitted from the slow-wave circuit, leading to a decrease in output of the traveling- or backward-wave tube, degradation in beam transmittance, an increase in noise, and the like, as well as a decrease in service life. In recent years, demands for a higher frequency and a higher output of a traveling-wave tube are increasing. In a helical slow-wave tube used for these purposes, the dielectric constant and the heat conductivity of dielectric pillars are important factors in addition to the heat resistance of the helix and the means for emitting heat from the helix.

In a conventional helical slow-wave circuit assembly, a helix is formed by using a round wire or a tape, and a plurality of cylindrical or prismatic dielectric pillars are disposed around the helix. This structure is housed in a metal cylinder, and the helix and the dielectric pillars are clamped and fixed by using an appropriate means. An example of this assembly will be described with reference to FIGS. 4A and 4B.

FIG. 4A is a sectional view of a conventional helical slow-wave circuit assembly, and FIG. 4B is a partial enlarged sectional view of a portion in the vicinity of a boron nitride (to be described as P-BN hereinafter) pillar of this assembly. As shown in FIGS. 4A and 4B, a helix 1 (see FIG. 4A) constituting the slow-wave circuit is made by forming tungsten or molybdenum, which is not easily softened or deformed by collision of electron beams and which has a comparatively high melting point, into a wire or a tape, and coiling it in a helical manner. Three prismatic P-BN pillars 2, 3, 4 are disposed around the helix 1 at angular intervals of 120°, and a metal cylinder 11 is provided to surround the P-BN pillars 2, 3, 4. The P-BN pillars 2 to 4 have a multilayered structure.

A direction of each P-BN pillar parallel to the layers is called a direction a, and a direction thereof perpendicular to the layers is called a direction c. A cross in FIG. 4A represents the tail feathers of an arrow traveling in direction c down the traveling wave tube. Generally, in P-BN, the directions a and c have largely different physical and mechanical characteristics, and characteristics in the direction a are superior to those in the direction c. Therefore, the P-BN pillars 2, 3, 4 are provided such that the directions a and c become respectively perpendicular and parallel to the contact surfaces between the helix 1 with the P-BN pillars 2, 3, 4.

In order to prevent a concentration of the mechanical stress which occurs upon insertion of the P-BN pillars 2, 3, 4 into the metal cylinder 11, the outer and inner circumferential surfaces of the respective P-BN pillars 2, 3, 4 are formed in accordance with a radius R of curvature of the metal cylinder 11 and the helix 1. Furthermore, conventionally, artificial diamond films 5, 6, 7 having a thickness of several μm are formed on the outer circumferential surfaces of the P-BN pillars 2, 3, 4, respectively, in accordance with chemical vapor deposition (to be referred to as CVD hereinafter), ion plating (to be referred to as IP hereinafter), or the like in order to increase the heat conductivity and mechanical strength.

The mechanical strength of the P-BN pillars 2, 3, 4 need be increased due to the following reason. More specifically, when the helix 1 and the P-BN pillars 2, 3, 4 are clamped by the metal cylinder 11, shearing stresses act on the helix 1 at portions corresponding to the central portions of the P-BN pillars and on the metal cylinder 11 corresponding to the two ends of each P-BN pillar. As described above, however, because of the characteristics and the manufacture of the P-BN pillars, the P-BN pillars 2, 3, 4, the helix 1, and the metal cylinder 11 contact with each other through the surfaces in the axis of the direction c.

When the helix 1 and the P-BN pillars 2, 3, 4 are clamped by the metal cylinder 11 in accordance with a squeezing to be described later, a shearing stress acts on the P-BN pillars 2, 3, 4, causing many cracks. This cracking adversely affects the RF characteristics of the traveling-wave tube and decreases the output and gain of the traveling-wave tube. Furthermore, when the cracks formed in the P-BN pillars 2, 3, 4 during clamping are subjected to thermal hysteresis and progress due to the operation of the traveling-wave tube, the traveling-wave tube may cause an operation error, which is a critical defect.

The artificial diamond films 5, 6, 7 are respectively formed on the outer circumferential surfaces of the P-BN pillars 2, 3, 4 in order to eliminate these drawbacks. Regarding the metal cylinder 11, since a means for applying a magnetic field for focusing the electron beams traveling in the helix 1 is to be arranged around the metal cylinder 11, mainly a stainless-steel tube, and recently, a tube constituted by layers of iron and a copper alloy and serving also as a vacuum envelope and enabled an overall reduction in size, are used as the metal cylinder 11.

To insert the helix 1 and the P-BN pillars 2, 3, 4 having the respective diamond films 5, 6, 7 into the metal cylinder 11, for example, the metal cylinder 11 is heated to utilize thermal expansion; or, a pressure is applied to the outer surface of the metal cylinder 11 in three directions to utilize mechanical deformation (squeezing). After insertion, heat or pressure is removed from the metal cylinder 11, so that the helix 1 and the P-BN pillars 2, 3, 4 are fixed and clamped, thereby completing a helical slow-wave circuit assembly.

In the conventional helical slow-wave circuit assembly described above, however, the P-BN pillars 2, 3, 4 are heated when the artificial diamond films 5, 6, 7 are respectively formed on the P-BN pillars 2, 3, 4 in accordance with CVD or IP processing. When the traveling- or backward-wave tube operates, nitrogen (N) in the P-BN pillars 2, 3, 4 are respectively diffused to the artificial diamond films 5, 6, 7, thereby decreasing the electrical resistance of the artificial diamond films 5, 6, 7. More specifically, diffusion of nitrogen (N) caused by heating the P-BN pillars 2, 3, 4 decreases the electrical resistance (resistivity) of the respective artificial diamond films 5, 6, 7 from $10^{11}$ Ω·cm to as low as $10^5$ to $10^6$ Ω·cm. When the electrical resistance of the surfaces of the P-BN pillars 2, 3, 4 serving as dielectric pillars is decreased in this manner, loss of the RF wave amplified while being transmitted through the helix 1 becomes considerably large, thereby extremely decreasing the output of the traveling- or backward-wave tube, which is a critical drawback.

SUMMARY OF THE INVENTION

It is an object of the present invention to provide a high-reliability helical slow-wave circuit assembly in which a decrease in output of a traveling- or backward-wave tube caused by RF loss is prevented.

In order to achieve the above object, according to the present invention, there is provided a helical slow-wave circuit assembly comprising a helix, constituting a slow-wave circuit of the electromagnetic wave with respect to an electron flow, for generating an electromagnetic wave that travels in the form of a current within said helical slow-wave circuit assembly, a plurality of dielectric pillars disposed equidistantly around the helix in a direction along which the electromagnetic wave travels and containing at least nitrogen, a metal cylinder for supporting the helix therein through the dielectric pillars, artificial diamond films formed on outer circumferential surfaces of the dielectric pillars, and intermediate layers, formed between the dielectric pillars and the artificial diamond films, for preventing diffusion of nitrogen from the dielectric pillars to the artificial diamond films.

BRIEF DESCRIPTION OF THE DRAWINGS

FIG. 2 is a partial enlarged sectional view of a portion (shown within a dashed line circle in FIG. 1A) in the vicinity of a P-BN pillar shown in FIGS. 1A and 1B;

FIG. 3A is a sectional view showing the second embodiment of the present invention, and FIG. 3B is a partial enlarged sectional view showing a portion (shown within a dashed line circle in FIG. 3A) in the vicinity of a P-BN pillar of the same.

DESCRIPTION OF THE PREFERRED EMBODIMENTS

The preferred embodiments of the present invention will be described with reference to the accompanying drawings.

Figure 1B:
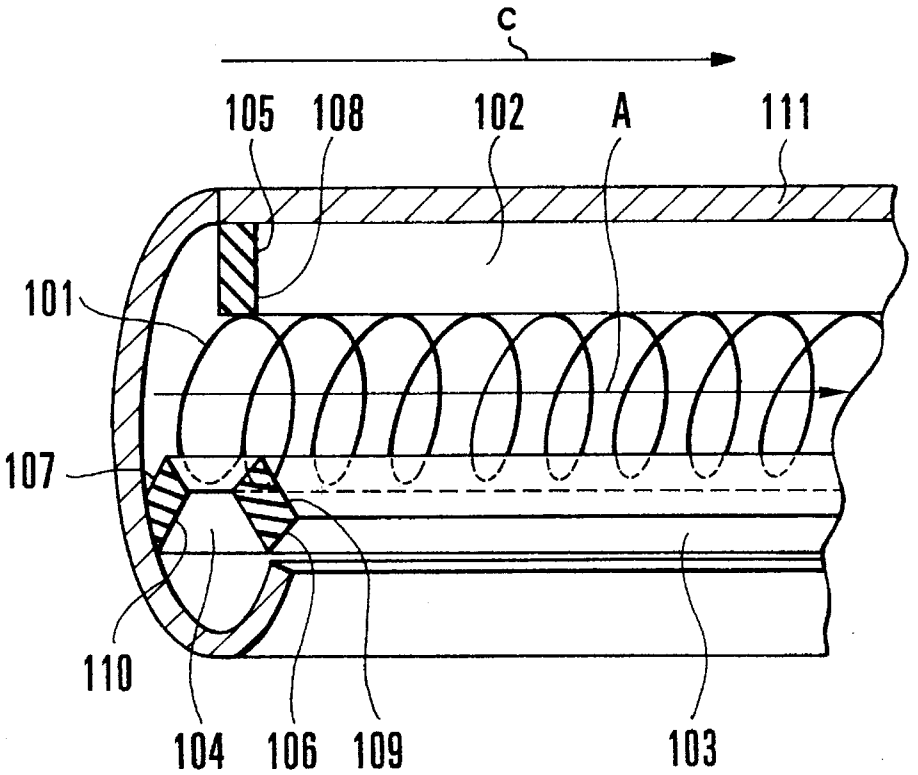
FIG. 1B is a partially cutaway perspective view of FIG. 1A.
Figure 1A:
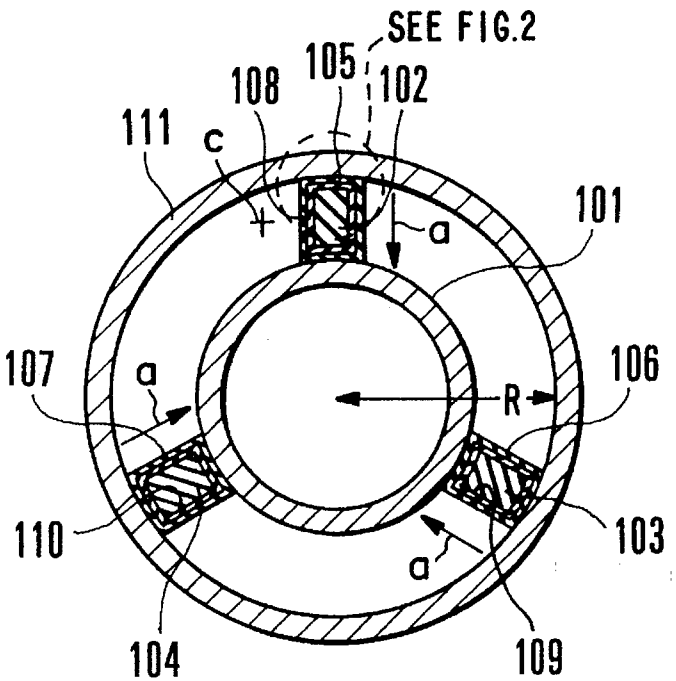
FIG. 1A is a sectional view showing a helical slow-wave circuit assembly according to the first embodiment of the present invention.
Figure 4B:
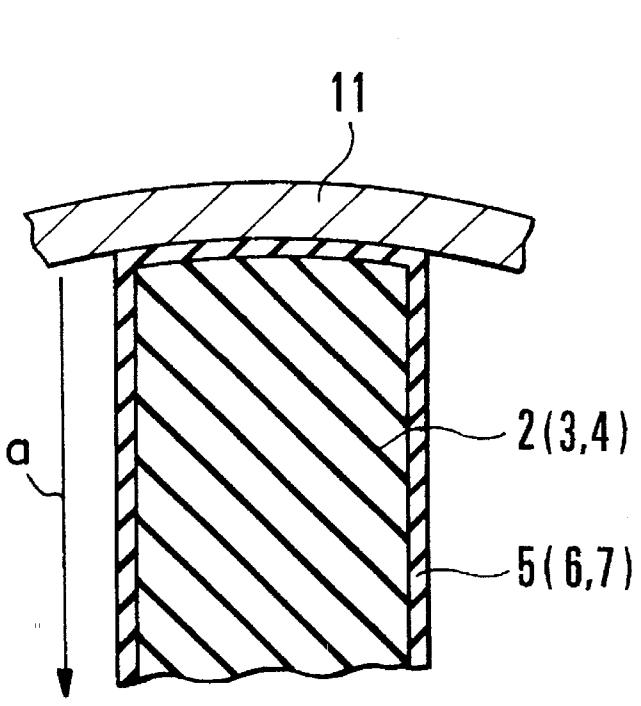
FIG.4B PRIOR ART
FIG. 4B is a partial enlarged sectional view of a portion of FIG. 4A in the vicinity of a P-BN pillar of the same.
Figure 4A:
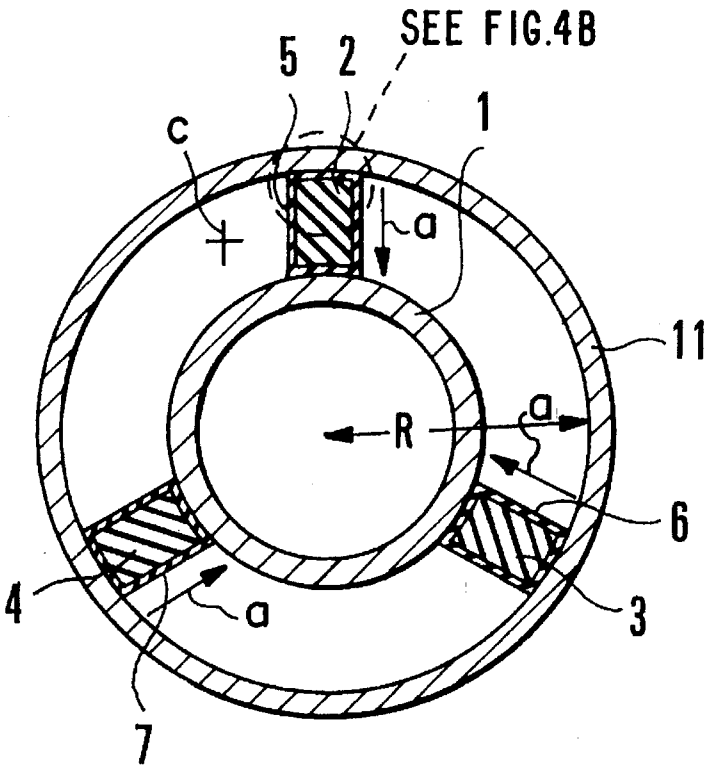
FIG.4A PRIOR ART
FIG. 4A is a sectional view of a conventional helical slow-wave circuit assembly.

FIGS. 1A and 1B show the first embodiment of the present invention, and FIG. 2 shows a portion of FIG. 1A in the vicinity of a P-BN pillar shown in FIGS. 1A and 1B. Referring to FIGS. 1A, 1B, and 2, reference numeral 101 (see FIGS. 1A, 1B and 2) denotes a helix constituting a slow-wave circuit of an electromagnetic wave. The helix 101 almost equalizes the traveling speed of the electromagnetic wave generated by a current flowing in the helix 101 with the speed of an electron beam A (see FIG. 1B) emitted from an electron gun (not shown) and passing through the helix 101. Reference numerals 102, 103, 104 denote three prismatic P-BN pillars disposed around the helix 101 at angular intervals of 120° in the traveling direction of the electromagnetic wave. Reference numeral 111 denotes a metal cylinder provided around the helix 101 through the P-BN pillars 102, 103, 104 as spacers.

The P-BN pillars 102, 103, 104 are constituted by multilayered structures each having a direction a parallel to the layers and a direction c perpendicular to the layers. The P-BN pillars 102, 103, 104 are disposed such that the directions a and c are respectively perpendicular and parallel to the contact surfaces with the helix 101. The outer and inner circumferential end faces of the P-BN pillars 102, 103, 104 are formed in accordance with a radius of curvature R (see FIG. 1A) of the metal cylinder 111 and the helix 101 in order to prevent a concentration of the mechanical stress which occurs upon insertion into the metal cylinder 111.

Artificial diamond films 105, 106, 107 are respectively formed on the outer circumferential surfaces of the P-BN pillars 102, 103, 104 in order to increase the heat conductivity and the mechanical strength in the same manner as in the conventional helical slow-wave circuit assembly. TiC layers 108, 109, 110 which do not easily react with the P-BN pillars 102, 103, 104 and the artificial diamond films 105, 106, 107 upon heat treatment are respectively formed between the P-BN pillars 102, 103, 104 and the artificial diamond films 105, 106, 107 as intermediate layers.

A method of manufacturing the helical slow-wave circuit assembly having the above arrangement will be described.

The P-BN pillars 102, 103, 104 have a height of 1 mm, a width of 0.5 mm, and a length of 100 mm, and their two surfaces in the widthwise direction are arcuatedly formed. The titanium carbide (to be referred to as TiC hereinafter) layers 108, 109, 110 are respectively formed on the surfaces of the P-BN pillars 102, 103, 104 to a thickness of 1 to 2 μm in accordance with plasma CVD. Subsequently the artificial diamond films 105, 106, 107 are respectively formed on the TiC layers 108, 109, 110 to a thickness of about 100 μm in accordance with plasma CVD. The helix 101 is made of tungsten, formed into a tape having a width of 1.5 mm and a thickness of 1 mm, and coiled to have an inner diameter of 2 mm. The P-BN pillars 102, 103, 104, having the TiC layers 108, 109, 110 and the artificial diamond films 105, 106, 107 formed thereon, are disposed around the helix 101 at angular intervals of 120°. The helix 101 and the P-BN pillars 102, 103, 104 are housed in the 0.4-mm thick 120-mm length metal cylinder 111 made of stainless steel, thereby completing a helical slow-wave circuit assembly.

In this case, the metal cylinder 111 is deformed by applying a pressure to its outer circumferential surface in three directions in accordance with squeezing. The helix 101 and the P-BN pillars 102, 103, 104 are inserted in the metal cylinder 111 by using an appropriate jig (not shown). Then, the pressure applied to the metal cylinder 111 is removed, so that the helix 101 and the P-BN pillars 102, 103, 104 are clamped by the restoring force of the metal cylinder 111.

According to this method, diffusion of nitrogen from the P-BN pillars 102, 103, 104 to the respective artificial diamond films 105, 106, 107 can be prevented in the presence of the TiC layers 108, 109, 110 respectively formed between the P-BN pillars 102, 103, 104 and the artificial diamond films 105, 106, 107.

FIGS. 3A shows the second embodiment of the present invention, and FIG. 3B shows a portion of FIG. 3A in the vicinity of a P-BN pillar of the same. Reference numeral 101 denotes a helix which is a slow-wave circuit. Reference numeral 111 denotes a metal cylinder. According to the second embodiment, as shown in FIGS. 3A and 3B, silicon carbide (to be referred to as SiC hereinafter) layers 112, 113, 114 are respectively formed between P-BN pillars 102, 103, 104 and artificial diamond films 105, 106, 107 in accordance with IP processing. The second embodiment (including helix 101 and metal cylinder 111) is the same as the first embodiment except that the SiC layers 112, 113, 114 are respectively formed between the P-BN pillars 102, 103, 104 and the artificial diamond films 105, 106, 107 in accordance with IP processing. It is known that SiC reacts less with the P-BN pillars and the diamond films in the same manner as TiC, so that the same effect as that of the first embodiment can be obtained.

As has been described above, according to the present invention, diffusion of nitrogen (N) from the P-BN pillars to the artificial diamond films can be prevented by providing, between nitrogen-containing dielectric pillars made of P-BN or the like and artificial diamond films, intermediate layers made of TiC or SiC which does not easily react with the dielectric pillars and the artificial diamond films upon heating. Then, the electric resistance of the diamond films is increased from a conventional value of $10^5$ to $10^6$ Ω·cm up to $10^{11}$ Ω·cm which is a value that the diamond film should originally have, thereby preventing a decrease in electric resistance. As a result, any loss in the RF wave transmitted through the helix during an operation of the traveling- or backward-wave tube becomes about ½ that the conventional value, so that a high-output, high-reliability slow-wave circuit assembly of a traveling-wave tube or the like can be obtained.

What is claimed is:

1. A helical slow-wave circuit assembly comprising:

a helix comprised of conductive material;

a plurality of dielectric pillars disposed equidistantly around a circumferential periphery of said helix and extended in an axis direction of said helix, said dielectric pillars having respective outer circumferential surfaces and containing at least nitrogen;

a metal cylinder for supporting said helix therein through a contact with each one of said dielectric pillars;

respective artificial diamond films disposed on the corresponding outer circumferential surfaces of said dielectric pillars; and intermediate layers disposed between said respective dielectric pillars and said corresponding artificial diamond films, for preventing a diffusion of nitrogen from said respective dielectric pillars to said corresponding artificial diamond films.

2. An assembly according to claim 1, wherein said respective intermediate layers are comprised of titanium carbide.

3. An assembly according to claim 1, wherein said respective intermediate layers are comprised of silicon carbide.

4. An assembly according to claim 1, wherein said respective dielectric pillars are comprised of boron nitride.

5. An assembly according to claim 1, wherein said respective intermediate layers are disposed on said outer circumferential surfaces of said dielectric pillars by an ion plating.

6. An assembly according to claim 1, wherein said respective intermediate layers are disposed on said outer circumferential surfaces of said dielectric pillars by a chemical vapor deposition.

* * * * *